US009677552B2

(12) United States Patent
Ota et al.

(10) Patent No.: US 9,677,552 B2
(45) Date of Patent: Jun. 13, 2017

(54) DOUBLE-HEADED PISTON TYPE SWASH PLATE COMPRESSOR

(71) Applicant: KABUSHIKI KAISHA TOYOTA JIDOSHOKKI, Aichi-ken (JP)

(72) Inventors: Masaki Ota, Kariya (JP); Kazunari Honda, Kariya (JP); Kei Nishii, Kariya (JP); Yusuke Yamazaki, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 373 days.

(21) Appl. No.: 14/330,302

(22) Filed: Jul. 14, 2014

(65) Prior Publication Data

US 2015/0023810 A1 Jan. 22, 2015

(30) Foreign Application Priority Data

Jul. 16, 2013 (JP) ..... 2013-147760

(51) Int. Cl.
*F04B 1/26* (2006.01)
*F04B 27/18* (2006.01)
*F04B 27/10* (2006.01)

(52) U.S. Cl.
CPC ..... *F04B 27/1804* (2013.01); *F04B 27/1054* (2013.01); *F04B 27/1072* (2013.01); *F04B 2027/1813* (2013.01)

(58) Field of Classification Search
CPC ..... F04B 27/1804; F04B 27/1072; F04B 27/1054; F04B 2027/1813
See application file for complete search history.

(56) References Cited

U.S. PATENT DOCUMENTS 4,108,577 A 8/1978 Brucken et al.
4,886,423 A * 12/1989 Iwanami ..... F04B 27/18 417/222.2

(Continued)

FOREIGN PATENT DOCUMENTS

CN 1082150 2/1994
CN 1031008 2/1996

(Continued)

OTHER PUBLICATIONS

Office Action issued in China Counterpart Patent Appl. No. 201410336013.6, dated Dec. 25, 2015 , along with an English translation thereof.

(Continued)

*Primary Examiner* — Charles Freay
(74) *Attorney, Agent, or Firm* — Greenblum & Bernstein, P.L.C.

(57) ABSTRACT

A double-headed piston type swash plate compressor includes first and second cylinder blocks, a rotation shaft, a double-headed piston, a crank chamber, a drive force transmission member, a swash plate, a movable body, a control pressure chamber, and a support. The control pressure chamber is defined by the movable body in the housing. The control pressure chamber moves the movable body in the axial direction of the rotation shaft. The support is located on the swash plate and supported by the rotation shaft. The drive force transmission member and the movable body are located at a first side of the swash plate in the axial direction of the rotation shaft, and the support is located at a second side of the swash plate. The drive force transmission member, the movable body, and the support set the inclination angle of the swash plate relative to the rotation shaft.

4 Claims, 13 Drawing Sheets

(56) References Cited

U.S. PATENT DOCUMENTS

| | | | | |
|---|---|---|---|---|
| 4,963,074 | A | 10/1990 | Sanuki et al. | |
| 5,002,466 | A * | 3/1991 | Inagaki | F04B 27/1072 417/222.1 |
| 5,259,736 | A * | 11/1993 | Terauchi | F01B 3/106 417/222.1 |
| 5,370,503 | A * | 12/1994 | Terauchi | F04B 27/1072 417/222.2 |
| 2001/0053326 | A1 | 12/2001 | Matsubara et al. | |
| 2014/0127041 | A1 | 5/2014 | Yamamoto et al. | |
| 2015/0285234 | A1 | 10/2015 | Nakaima et al. | |

FOREIGN PATENT DOCUMENTS

| | | |
|---|---|---|
| JP | 05-172052 | 7/1993 |
| JP | 07-310653 | 11/1995 |
| JP | 2000-161207 | 6/2000 |
| JP | 2010-90783 | 4/2010 |
| KR | 2013-0025094 | 3/2013 |
| WO | 2014/069618 | 5/2014 |

OTHER PUBLICATIONS

Office Action issued in Germany Counterpart Patent Appl. No. 102014213702.0, dated Feb. 21, 2017.

* cited by examiner

DOUBLE-HEADED PISTON TYPE SWASH PLATE COMPRESSOR

BACKGROUND OF THE INVENTION

The present invention relates to a double-headed piston type swash plate compressor including a double-headed piston that is coupled to a swash plate and reciprocated by a stroke corresponding to the inclination angle of the swash plate.

Japanese Laid-Open Patent Publication No. 5-172052 describes a double-headed piston type swash plate compressor (hereinafter simply referred to as the "compressor"). Referring to FIGS. 13 and 14, in the above publication, a compressor 100 includes a housing 101, which is formed by a cylinder block 102, a front housing 104 that closes the front end of the cylinder block 102 with a valve plate 103*a* arranged in between, and a rear housing 105 that closes the rear end of the cylinder block 102 with a valve plate 103*b* arranged in between.

A bore 102*h* extends through the central portion of the cylinder block 102. A rotation shaft 106, which extends through the front housing 104, is set in the bore 102*h*. Cylinder bores 107 are formed in the cylinder block 102 around the rotation shaft 106. Each cylinder bore 107 accommodates a double-headed piston 108. A crank chamber 102*a* is defined in the cylinder block 102. The crank chamber 102*a* accommodates a swash plate 109, which is rotated by drive force from the rotation shaft 106. The inclination angle of the swash plate 109 is changeable. Each double-headed piston 108 is coupled to the swash plate 109 by shoes 110. The front housing 104 includes suction chambers 104*a* and discharge chambers 104*b*. The rear housing 105 includes suction chambers 105*a* and discharge chambers 105*b*. Each suction chamber 104*a* and each discharge chamber 104*b* are in communication with a corresponding one of the cylinder bores 107. Each suction chamber 105*a* and each discharge chamber 105*b* are in communication with a corresponding one of the cylinder bores 107.

An actuator 111 is arranged in the rear portion of the bore 102*h* in the cylinder block 102. The actuator 111 accommodates the rear end of the rotation shaft 106. The rear end of rotation shaft 106 is slidable in the actuator 111 relative to the actuator 111. The circumference of the actuator 111 is slidable relative to the bore 102*h*. A pushing spring 112 is arranged between the actuator 111 and the valve plate 103*b*. The pushing spring 112 pushes the actuator 111 toward the distal end of the rotation shaft 106, that is, toward the left side as viewed in FIG. 13. The urging force of the pushing spring 112 is set in balance with the pressure of the crank chamber 102*a*.

The bore 102*h* extends toward the rear from the actuator 111 and is in communication through a hole in the valve plate 103*b* with a pressure regulation chamber 117 (control pressure chamber), which is formed in the rear housing 105. The pressure regulation chamber 117 is in communication with the discharge chambers 105*b* through a pressure regulation circuit 118. A pressure control valve 119 is arranged in the pressure regulation circuit 118. The pressure of the pressure regulation chamber 117 regulates the movement amount of the actuator 111.

In the bore 102*h*, a first coupling body 114 is arranged in front of the actuator 111 with a thrust bearing 113 arranged in between. The rotation shaft 106 extends through the first coupling body 114. The rotation shaft 106 is slidable relative to the first coupling body 114. Slidable movement of the actuator 111 moves the first coupling body 114 along the rotation shaft 106. A first arm 114*a* extends toward the outer side from the circumference of the first coupling body 114. The first arm 114*a* includes a first pin guide groove 114*h* that extends diagonally relative to the axial direction of the rotation shaft 106.

In the bore 102*h*, a second coupling body 115 (drive force transmission member) is arranged in front of the swash plate 109. The second coupling body 115 is fixed to the rotation shaft 106 to rotate integrally with the rotation shaft 106. A second arm 115*a* extends toward the outer side from the circumference of the second coupling body 115 at a position that is substantially symmetric to the first arm 114*a*. The second arm 115*a* includes a second pin guide groove 115*h* that extends diagonally relative to the axial direction of the rotation shaft 106.

The swash plate 109 includes a rear surface, which is closer to the first coupling body 114, and a front surface, which is closer to the second coupling body 115. Two first supports 109*a* extend toward the first arm 114*a* from the rear surface of the swash plate 109. The first arm 114*a* is located between the two first supports 109*a*. A first coupling pin 114*p*, which is inserted through the first pin guide groove 114*h*, pivotally couples the two supports 109*a* and the first arm 114*a*.

Two second supports 109*b* extend toward the second arm 115*a* from the front surface of the swash plate 109. The second arm 115*a* is located between the two second supports 109*b*. A second coupling pin 115*p*, which is inserted through the second pin guide groove 115*h*, pivotally couples the two supports 109*b* and the second arm 115*a*. The swash plate 109 is rotated by drive force received from the rotation shaft 106 through the second coupling body 115.

When decreasing the displacement of the compressor 100, the pressure control valve 119 is closed to lower the pressure of the pressure regulation chamber 117. As a result, the pressure of the crank chamber 102*a* becomes higher than the sum of the pressure of the pressure regulation chamber 117 and the urging force of the pushing spring 112. This moves the actuator 111 toward the valve plate 103*b* as shown in FIG. 13. As a result, the pressure of the crank chamber 102*a* pushes the first coupling body 114 toward the actuator 111. The movement of the first coupling body 114 rotates the first supports 109*a* in the counterclockwise direction as the first pin guide groove 114*h* guides the first coupling pin 114*p*. The rotation of the first supports 109*a* rotates the second supports 109*b* in the counterclockwise direction as the second pin guide groove 115*h* guides the second coupling pin 115*p*. This decreases the inclination angle of the swash plate 109. Consequently, the stroke of the double-headed pistons 108 is decreased, and the displacement of the compressor 100 is decreased.

When increasing the displacement of the compressor 100, the pressure control valve 119 is opened to draw high-pressure gas (control gas) from the discharge chambers 105*b* through the pressure regulation circuit 118 and into the pressure regulation chamber 117 to increase the pressure of the pressure regulation chamber 117. As a result, the sum of the pressure of the pressure regulation chamber 117 and the urging force of the pushing spring 112 becomes higher than the pressure of the crank chamber 102*a*. This moves the actuator 111 toward the swash plate 109 as shown in FIG. 14. As a result, the actuator 111 pushes the first coupling body 114 toward the second coupling body 115. The movement of the first coupling body 114 rotates the first supports 109*a* in the clockwise direction as the first pin guide groove 114*h* guides the first coupling pin 114*p*. The rotation of the first supports 109*a* rotates the second supports 109*b* in the clockwise direction as the second pin guide groove 115*h* guides the second coupling pin 115*p*. This increases the inclination angle of the swash plate 109. Consequently, the stroke of the double-headed pistons 108 is increased, and the displacement of the compressor 100 is increased. In this manner, the actuator 111 and the first coupling body 114 form a movable body that is movable in the axial direction of the rotation shaft 106 to change the inclination angle of the swash plate 109.

In the compressor 100 of the above embodiment, each cylinder bore 107 accommodates one of the double-headed pistons 108. In such a structure, each double-headed piston 108 reciprocates in the cylinder block 102 at the outer side of the rotation shaft 106 in the radial direction. This restricts the positions of the second coupling body 115, the actuator 111, and the first coupling body 114 in the cylinder block 102 to the radially inner side of the region where the double-headed pistons 108 reciprocate. Further, the compressor 100 needs to be compact to fit into the space that is available in a vehicle. This restricts the area in the cylinder block 102 that can be occupied by the second coupling body 115, the actuator 111, and the first coupling body 114. It is thus desirable that the area occupied in the cylinder block 102 by the second coupling body 115, the actuator 111, and the first coupling body 114 be minimized to limit enlargement of the compressor 100. However, when the actuator 111 is reduced in size, the swash plate 109 may not be able to smoothly change the inclination angle.

SUMMARY OF THE INVENTION

It is an object of the present invention to provide a double-headed piston type swash plate compressor that smoothly changes the inclination angle of the swash plate while limiting enlargement of the compressor.

To achieve the above object, one aspect of the present invention provides a double-headed piston type swash plate compressor including a first cylinder block and a second cylinder block, a rotation shaft, a double-headed piston, a crank chamber, a drive force transmission member, a swash plate, a movable body, a control pressure chamber, and a support. The first and second cylinder blocks form a housing. The first cylinder block includes a first cylinder bore, and the second cylinder block includes a second cylinder bore. The double-headed piston is accommodated in the first cylinder bore and the second cylinder bore. The double-headed piston is movable back and forth in the first cylinder bore and the second cylinder bore. The drive force transmission member is accommodated in the crank chamber and fixed to the rotation shaft. The drive force transmission member is rotatable integrally with the rotation shaft. The swash plate is accommodated in the crank chamber. The swash plate is rotated when receiving drive force from the rotation shaft through the drive force transmission member. The swash plate is inclined at an angle relative to the rotation shaft that is changeable. The swash plate is coupled to the double-headed piston. The double headed piston moves back and forth with a stroke that is in accordance with the inclination angle of the swash plate. The movable body is coupled to the swash plate. The movable body is capable of changing the inclination angle of the swash plate. The control pressure chamber is defined by the movable body in the housing. The control pressure chamber draws in control gas that changes the pressure in the control pressure chamber to move the movable body in an axial direction of the rotation shaft. The support is located on the swash plate and supported by the rotation shaft. The drive force transmission member and the movable body are located at a first side of the swash plate in the axial direction of the rotation shaft. The support is located at a second side of the swash plate that is opposite from the first side in the axial direction of the rotation shaft. The swash plate is supported by the rotation shaft through the drive force transmission member, the movable body, and the support. The inclination angle of the swash plate relative to the rotation shaft is set by the drive force transmission member, the movable body, and the support.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A first embodiment of the present invention will now be described with reference to FIGS. 1 to 7. A double-headed piston type swash plate compressor (hereinafter simply referred to as the "compressor") is installed in a vehicle.

Figure 1:
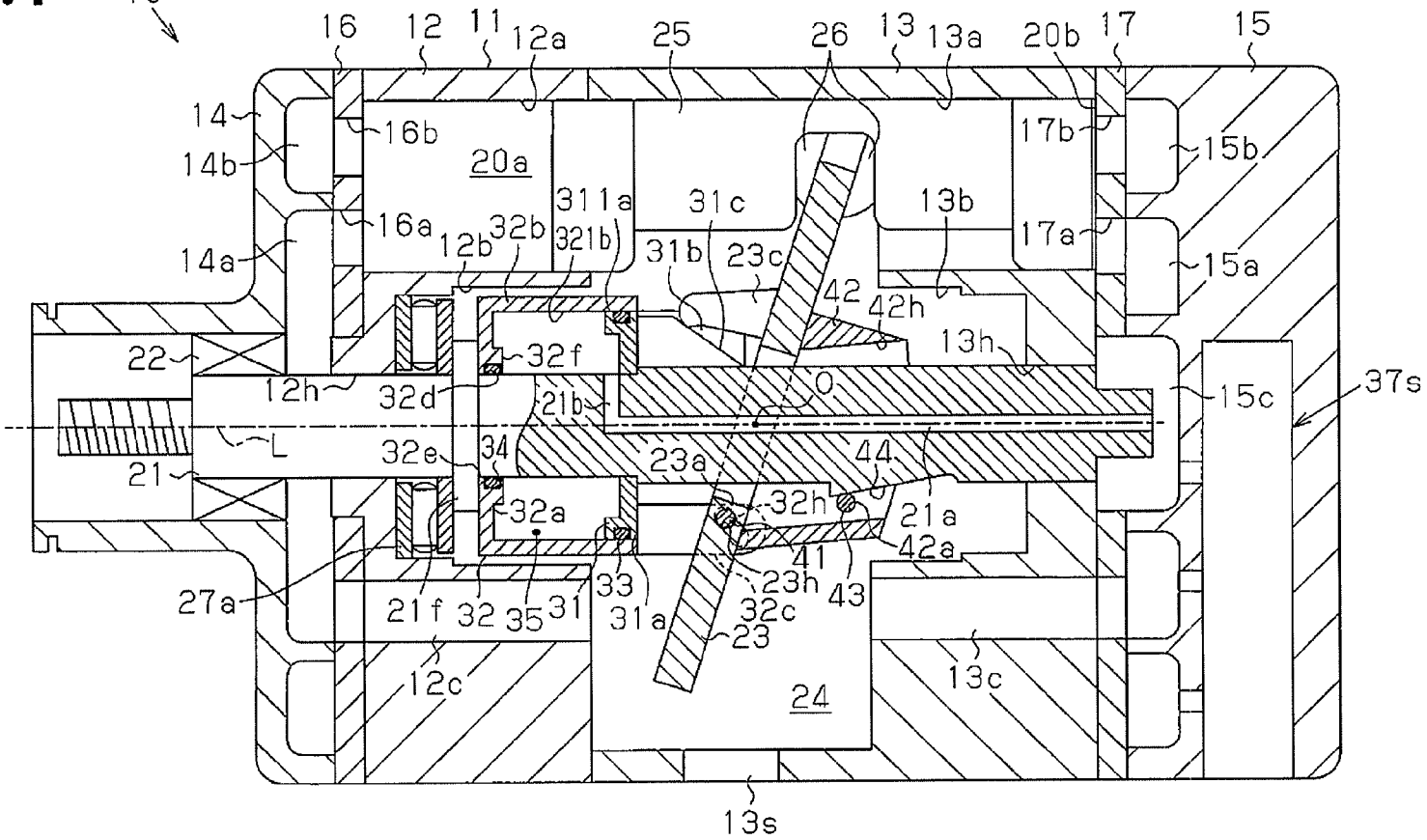
FIG. 1 is a cross-sectional side view showing a double-headed piston type swash plate compressor according to a first embodiment of the present invention.

The left side, right side, upper side, and lower side as viewed in FIG. 1 respectively correspond to a first side (front side), second side (rear side), third side (upper side), and fourth side (lower side). A compressor 10 includes a housing 11 formed by a first cylinder block 12 located at the first side, a second cylinder block 13 located at the second side, a front housing 14 coupled to the first cylinder block 12, and a rear housing 15 coupled to the second cylinder block 13. The first cylinder block 12 and the second cylinder block 13 are coupled to each other.

A first valve-port formation body 16 is arranged between the front housing 14 and the first cylinder block 12. A second valve-port formation body 17 is arranged between the rear housing 15 and the second cylinder block 13.

A suction chamber 14*a* and a discharge chamber 14*b* are defined between the front housing 14 and the first valve-port formation body 16. The discharge chamber 14*b* is located at the radially outer side of the suction chamber 14*a*. A suction chamber 15*a* and a discharge chamber 15*b* are defined between the rear housing 15 and the second valve-port formation body 17. The rear housing 15 includes a pressure regulation chamber 15*c*. The pressure regulation chamber 15*c* is located at a central portion of the rear housing 15. The suction chamber 15*a* is located at the radially outer side of the pressure regulation chamber 15*c*. The discharge chamber 15*b* is located at the radially outer side of the suction chamber 15*a*. A discharge passage (not shown) connects the discharge chambers 14*b* and 15*b*. The discharge passage is connected to an external refrigerant circuit (not shown).

The first valve-port formation body 16 includes a suction port 16*a*, which is in communication with the suction chamber 14*a*, and a discharge port 16*b*, which is in communication with the discharge chamber 14*b*. The second valve-port formation body 17 includes a suction port 17*a*, which is in communication with the suction chamber 15*a*, and a discharge port 17*b*, which is in communication with the discharge chamber 15*b*. Each of the suction ports 16*a* and 17*a* includes a suction valve mechanism (not shown), and each of the discharge ports 16*b* and 17*b* includes a discharge valve mechanism (not shown).

A rotation shaft 21 is held to be rotatable in the housing 11. The rotation shaft 21 includes a front end portion inserted into a shaft hole 12*h* extending through the first cylinder block 12. The front end portion of the rotation shaft 21 is located at the front side of the housing 11 and is defined by the portion of the rotation shaft 21 near the front end in the direction of the axis L (axial direction of rotation shaft 21). The front end of the rotation shaft 21 is located in the front housing 14. Further, the rotation shaft 21 includes a rear end portion inserted into a shaft hole 13*h* extending through the second cylinder block 13. The rear end portion of the rotation shaft 21 is located at the rear side of the housing 11 and is defined by the portion of the rotation shaft 21 near the rear end in the axial direction of rotation shaft 21. The rear end of the rotation shaft 21 is located in the pressure regulation chamber 15*c*.

The front end portion of the rotation shaft 21 is supported to be rotatable by the first cylinder block 12 in the shaft hole 12*h*. The rear end portion of the rotation shaft 21 is supported to be rotatable by the second cylinder block 13 in the shaft hole 13*h*. A shaft seal 22, which is of a lip seal type, is arranged between the front housing 14 and the rotation shaft 21.

The first cylinder block 12 and the second cylinder block 13 define a crank chamber 24 in the housing 11. The crank chamber 24 accommodates a swash plate 23, which is rotated by drive force from the rotation shaft 21. The swash plate 23 is inclinable relative to the axial direction of the rotation shaft 21. The swash plate 23 includes an insertion hole 23*a* through which the rotation shaft 21 can be inserted. The swash plate 23 includes an upper half located at the upper side of the center O and a lower half located at the lower side of the center O.

The first cylinder block 12 includes first cylinder bores 12*a* formed around the rotation shaft 21. FIG. 1 shows only one first cylinder bore 12*a*. Each first cylinder bore 12*a* extends through the first cylinder bore 12*a* in the axial direction. Further, each cylinder bore 12*a* is in communication with the suction chamber 14*a* through the suction port 16*a* and in communication with the discharge chamber 14*b* through the discharge port 16*b*. The second cylinder block 13 includes second cylinder bores 13*a* formed around the rotation shaft 21. FIG. 1 shows only one second cylinder bore 13*a*. Each second cylinder bore 13*a* extends through the second cylinder bore 13*a* in the axial direction. Further, each second cylinder bore 13*a* is in communication with the suction chamber 15*a* through the suction port 17*a* and in communication with the discharge chamber 15*b* through the discharge port 17*b*. Corresponding ones of the first and second cylinder bores 12*a* and 13*a* are paired at the front and rear of the compressor 10. A double-headed piston 25 is accommodated in each of the paired first and second cylinder bores 12*a* and 13*a* to be movable back and forth in the axial direction of the compressor 10.

Two shoes 26 couple each double-headed piston 25 to the peripheral portion of the swash plate 23. The shoes 26 convert rotation of the swash plate 23, which is rotated by the rotation shaft 21, to linear reciprocation of the double-headed piston 25. The double-headed piston 25 and the first valve-port formation body 16 define a first compression chamber 20*a* in each first cylinder bore 12*a*. The double-headed piston 25 and the second valve-port formation body 17 define a second compression chamber 20*b* in each second cylinder bore 13*a*.

The first cylinder block 12 includes a first large diameter hole 12*b*, which is in communication with the shaft hole 12*h* and has a larger diameter than the shaft hole 12*h*. The first large diameter hole 12*b* is in communication with the crank chamber 24. The crank chamber 24 and the suction chamber 14*a* are in communication through a suction passage 12*c*, which extends through the first cylinder block 12 and the first valve-port formation body 16.

The second cylinder block 13 includes a second large diameter hole 13*b*, which is in communication with the shaft hole 13*h* and has a larger diameter than the shaft hole 13*h*. The second large diameter hole 13*b* is in communication with the crank chamber 24. The crank chamber 24 and the suction chamber 15*a* are in communication through a suction passage 13*c*, which extends through the second cylinder block 13 and the second valve-port formation body 17.

The circumferential wall of the second cylinder block 13 includes an inlet 13*s*, which is connected to an external refrigerant circuit. Refrigerant gas is drawn into the crank chamber 24 through the inlet 13*s*. Then, the refrigerant gas is drawn through the suction passages 12*c* and 13*c* into the suction chambers 14*a* and 15*a*. In this manner, the suction chambers 14*a* and 15*a* and the crank chamber 24 form a suction pressure region. The pressure is substantially equal throughout the suction pressure region.

An annular flange 21*f* projects from the rotation shaft 21 in the first large diameter hole 12*b*. A thrust bearing 27*a* is arranged between the flange 21*f* and the first cylinder block 12 in the axial direction of the rotation shaft 21.

An annular drive force transmission member 31 is fixed to the rotation shaft 21 between the flange 21*f* and the swash plate 23. The drive force transmission member 31 is rotatable integrally with the rotation shaft 21. The drive force transmission member 31 includes an annular main body 31*a* and two arms 31*b*, which project from an end face of the main body 31*a* toward the swash plate 23. A bottom portion defining a guide surface 31*c* extends between the two arms 31*b*.

A projection 23*c* projects from the upper half of the swash plate 23 toward the drive force transmission member 31. The projection 23*c* is located between the two arms 31*b*. The projection 23*c* is movable along the guide surface 31*c* between the two arms 31*b*. The projection 23*c* includes a distal end portion that is capable of sliding on the guide surface 31*c*. The projection 23*c* and the guide surface 31*c* cooperate to allow the swash plate 23 to incline in the axial direction of the rotation shaft 21. The two arms 31*b* transmit drive force from the rotation shaft 21 to the projection 23*c*. This rotates the swash plate 23. When inclining the swash plate 23 in the axial direction of the rotation shaft 21, the distal end portion of the projection 23*c* slides on the guide surface 31*c*.

A movable body 32 is arranged between the flange 21*f* and the drive force transmission member 31. The movable body 32 is tubular and has a closed end. Further, the movable body 32 is movable in the axial direction of the rotation shaft 21 relative to the drive force transmission member 31. The drive force transmission member 31 and the movable body 32 are accommodated in the first cylinder block 12 and the second cylinder block 13 in a region located at the inner side of where the double-headed pistons 25 reciprocate in the radial direction of the rotation shaft 21. The drive force transmission member 31 and the movable body 32 are arranged at the front side of the swash plate 23 in the axial direction of the rotation shaft 21.

The movable body 32 includes an annular end portion 32*a* and a tubular portion 32*b*. The end portion 32*a* includes an insertion hole 32*e* through which the rotation shaft 21 is inserted. The tubular portion 32*b* extends from the outer circumference of the end portion 32*a* in the axial direction of the rotation shaft 21 and covers the rotation shaft 21. The movable body 32 moves in the axial direction of the rotation shaft 21 as an inner circumferential surface 321*b* of the tubular portion 32*b* slides along an outer circumferential surface 311*a* of the main body 31*a* of the drive force transmission member 31. The movable body 32 is rotatable integrally with the rotation shaft 21. A seal 33 seals the gap between the inner circumferential surface 321*b* of the tubular portion 32*b* and the main body 31*a* of the drive force transmission member 31.

A protrusion 32*f* projects from the end portion 32*a* where the rotation shaft 21 is inserted toward the drive force transmission member 31 in the axial direction of the rotation shaft 21. An inner circumferential surface of the protrusion 32*f* includes an annular holding groove 32*d*. The holding groove 32*d* receives a seal 34 that seals the gap between the wall of the insertion hole 32*e* and the rotation shaft 21. The drive force transmission member 31 and the movable body 32 define a control pressure chamber 35.

The rotation shaft 21 includes a first in-shaft passage 21*a*, which extends in the axial direction of the rotation shaft 21. The first in-shaft passage 21*a* includes a rear end that opens to the pressure regulation chamber 15*c*. Further, the rotation shaft 21 includes a second in-shaft passage 21*b*, which extends in the radial direction of the rotation shaft 21. The second in-shaft passage 21*b* includes a rear end that is in communication with a distal end of the first in-shaft passage 21*a*. The control pressure chamber 35 and the pressure regulation chamber 15*c* are in communication through the first in-shaft passage 21*a* and the second in-shaft passage 21*b*.

Figure 2:
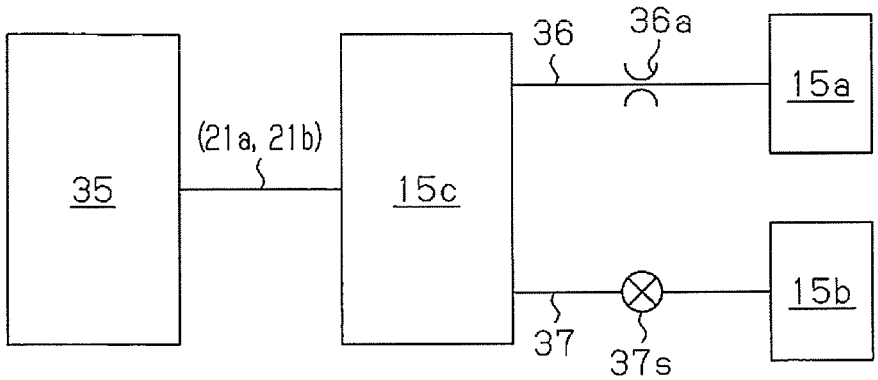
FIG. 2 is a schematic diagram showing the relationship of a control pressure chamber, a pressure regulation chamber, a suction chamber, and a discharge chamber in FIG. 1.

As shown in FIG. 2, the pressure regulation chamber 15*c* and the suction chamber 15*a* are in communication through a bleeding passage 36. The bleeding passage 36 includes an orifice 36*a* that throttles the flow rate of the refrigerant gas flowing through the bleeding passage 36. The pressure regulation chamber 15*c* and the discharge chamber 15*b* are in communication through a gas supplying passage 37. An electromagnetic control valve 37*s* is arranged in the gas supplying passage 37. The control valve 37*s* is capable of regulating the open amount of the gas supplying passage 37 based on the pressure of the suction chamber 15*a*. The control valve 37*s* regulates the flow rate of the refrigerant gas flowing through the gas supplying passage 37.

The pressure in the control pressure chamber 35 is adjusted by drawing refrigerant gas from the discharge chamber 15*b* into the control pressure chamber 35 through the gas supplying passage 37, the pressure regulation chamber 15*c*, the first in-shaft passage 21*a*, and the second in-shaft passage 21*b* and discharging refrigerant gas from the control pressure chamber 35 into the suction chamber 15*a* through the second in-shaft passage 21*b*, the first in-shaft passage 21*a*, the pressure regulation chamber 15*c*, and the bleeding passage 36. The pressure difference of the control pressure chamber 35 and the crank chamber 24 moves the movable body 32 relative to the drive force transmission member 31 in the axial direction of the rotation shaft 21. Thus, the refrigerant gas drawn into the control pressure chamber 35 moves the movable body 32 in the axial direction of the rotation shaft 21.

As shown in FIG. 1, a coupling portion 32*c* projects from the distal end of the tubular portion 32*b* of the movable body 32 toward the swash plate 23. The coupling portion 32*c* includes an elongated insertion hole 32*h* into which a cylindrical pin 41 is insertable. Further, the lower half of the swash plate 23 includes a circular insertion hole 23*h* into which the pin 41 is insertable. The pin 41 is fitted to the insertion hole 23*h* and restrained by the swash plate 23. The pin 41 couples the coupling portion 32*c* to the lower half of the swash plate 23. The pin 41 is fitted into the insertion hole 23*h* and held on the swash plate 23. The pin 41 is held to be movable in the insertion hole 32*h*.

A tubular member 42 is arranged integrally on the rear surface of the swash plate 23, that is, the end face of the swash plate 23 opposite to the drive force transmission member 31. The tubular member 42 includes a through hole 42*h* that is in communication with the insertion hole 23*a* of the swash plate 23. The tubular member 42 includes two insertion holes 42*a* that open in the through hole 42*h*. A cylindrical abutment pin 43 is inserted through the two insertion holes 42*h*. The abutment pin 43 bridges different wall portions of the through hole 42*h* so as to extend across the interior of the through hole 42*h*. The abutment pin 43 is located at the rear side of the swash plate 23 in the axial direction of the rotation shaft 21.

The rotation shaft 21 includes a guide surface 44 that guides the abutment pin 43 as the inclination angle of the swash plate 23 changes. The abutment pin 43 slides and moves on the guide surface 44. The guide surface 44 is linearly sloped to approach the axis L of the rotation shaft 21 at locations farther from the swash plate 23.

In the compressor 10, a decrease in the open amount of the control valve 37*s* reduces the amount of refrigerant gas drawn into the control pressure chamber 35 from the discharge chamber 15*b* through the gas supplying passage 37, the pressure regulation chamber 15*c*, the first in-shaft passage 21*a*, and the second in-shaft passage 21*b*. The discharge of refrigerant gas from the control pressure chamber 35 to the suction chamber 15*a* through the second in-shaft passage 21*b*, the first in-shaft passage 21*a*, the pressure regulation chamber 15*c*, and the bleeding passage 36 results in the pressure of the control pressure chamber 35 approaching the pressure of the suction chamber 15*a*. A decrease in the pressure difference between the control pressure chamber 35 and the crank chamber 24 moves the movable body 32 in the axial direction of the rotation shaft 21 so that the end portion 32*a* approaches the drive force transmission member 31.

Figure 3:
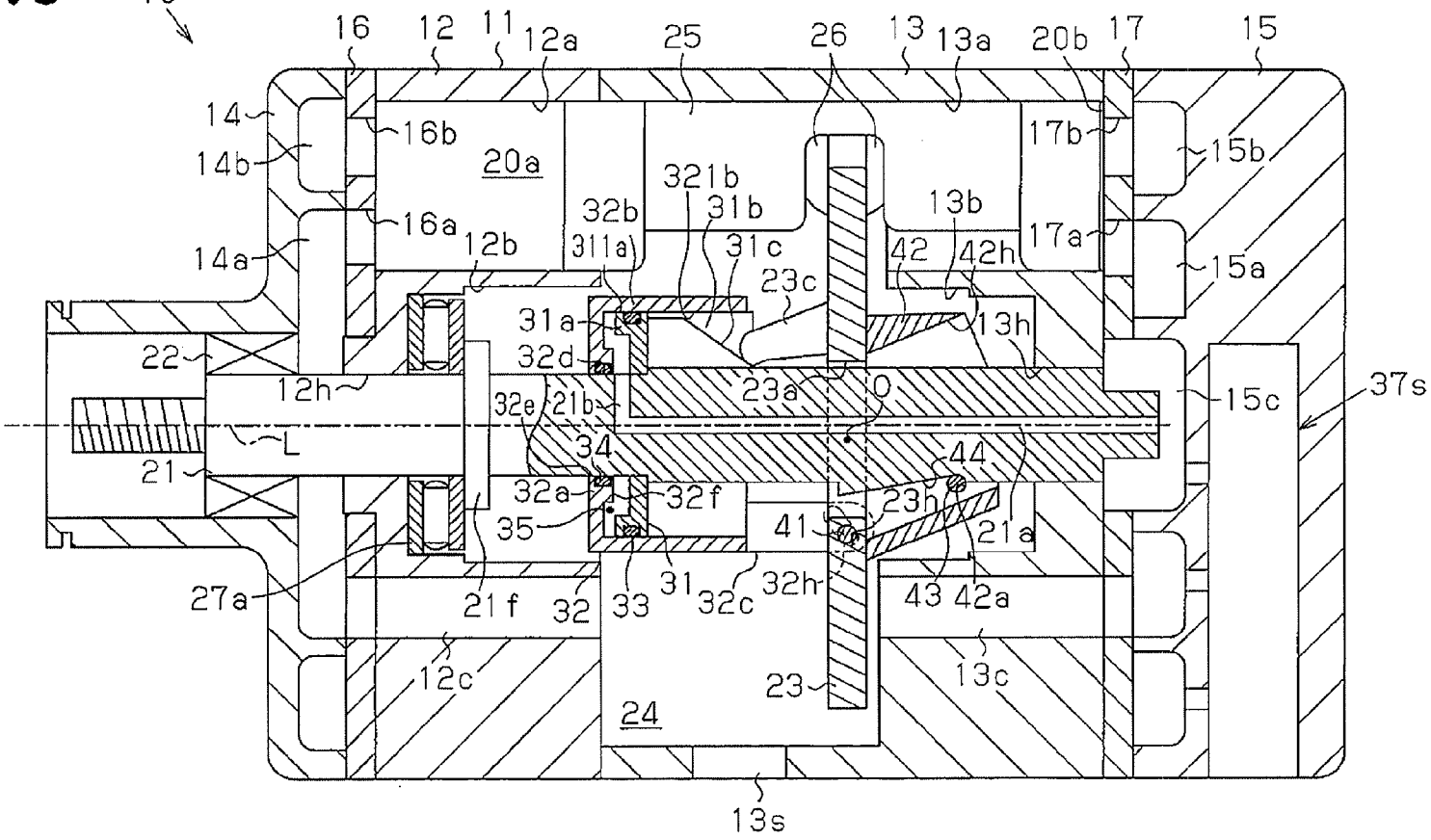
FIG. 3 is a cross-sectional side view showing the compressor of FIG. 1 when a swash plate is located at a minimum inclination angle position.

Referring to FIG. 3, the pin 41 moves inside the insertion hole 32*h* so that the projection 23*c* approaches the rotation shaft 21 on the guide surface 31*c*. Further, the abutment pin 43 moves along the guide surface 44 to approach the axis L of the rotation shaft 21. As a result, the lower half of the swash plate 23 is moved away from the drive force transmission member 31. This decreases the inclination angle of the swash plate 23. Thus, the stroke of the double-headed pistons 25 decreases and the displacement of the compressor 10 decreases.

An increase in the open amount of the control valve 37*s* increases the amount of refrigerant gas drawn into the control pressure chamber 35 from the discharge chamber 15*b* through the gas supplying passage 37, the pressure regulation chamber 15*c*, the first in-shaft passage 21*a*, and the second in-shaft passage 21*b*. Thus, the pressure of the control pressure chamber 35 approaches the pressure of the discharge chamber 15*b*. The increase in the pressure difference between the control pressure chamber 35 and the crank chamber 24 moves the movable body 32 in the axial direction of the rotation shaft 21 so that the end portion 32*a* moves away from the drive force transmission member 31.

Referring to FIG. 1, the pin 41 is moved in the insertion hole 32*h*, and the projection 23*c* is moved on the guide surface 31*c* away from the rotation shaft 21. Further, the abutment pin 43 is moved along the guide surface 44 away from the axis L of the rotation shaft 21. As a result, the lower half of the swash plate 23 is moved toward the drive force transmission member 31. This increases the inclination angle of the swash plate 23. Thus, the stroke of the double-headed pistons 25 increases and the displacement of the compressor 10 increases. In this manner, by permitting movement of the movable body 32 in the axial direction of the rotation shaft 21, the inclination angle of the swash plate 23 is changed in accordance with changes in the internal pressure of the control pressure chamber 35.

Figure 4:
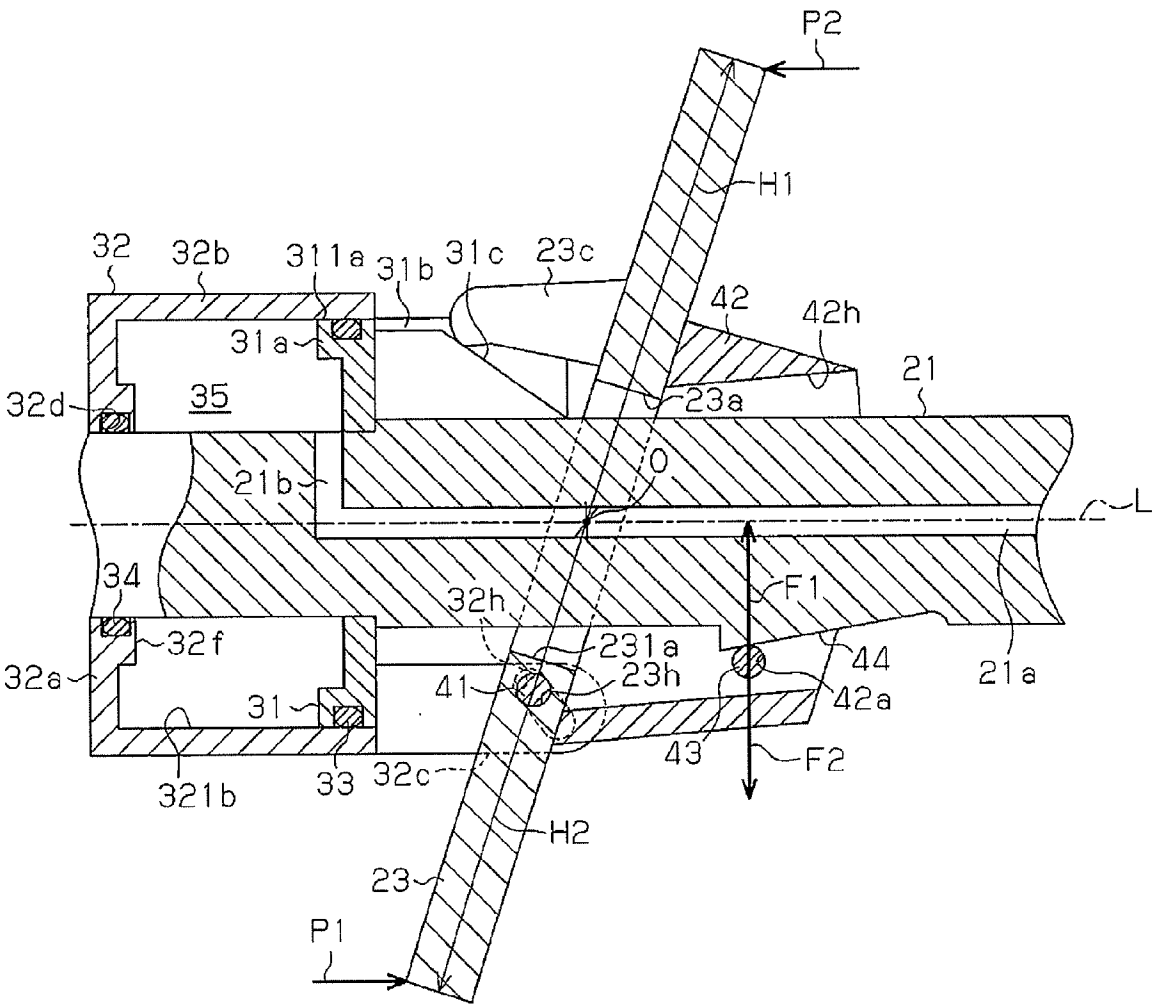
FIG. 4 is a partial, cross-sectional side view showing the compressor of FIG. 1 when the swash plate is located at a maximum inclination angle position.
Figure 5:
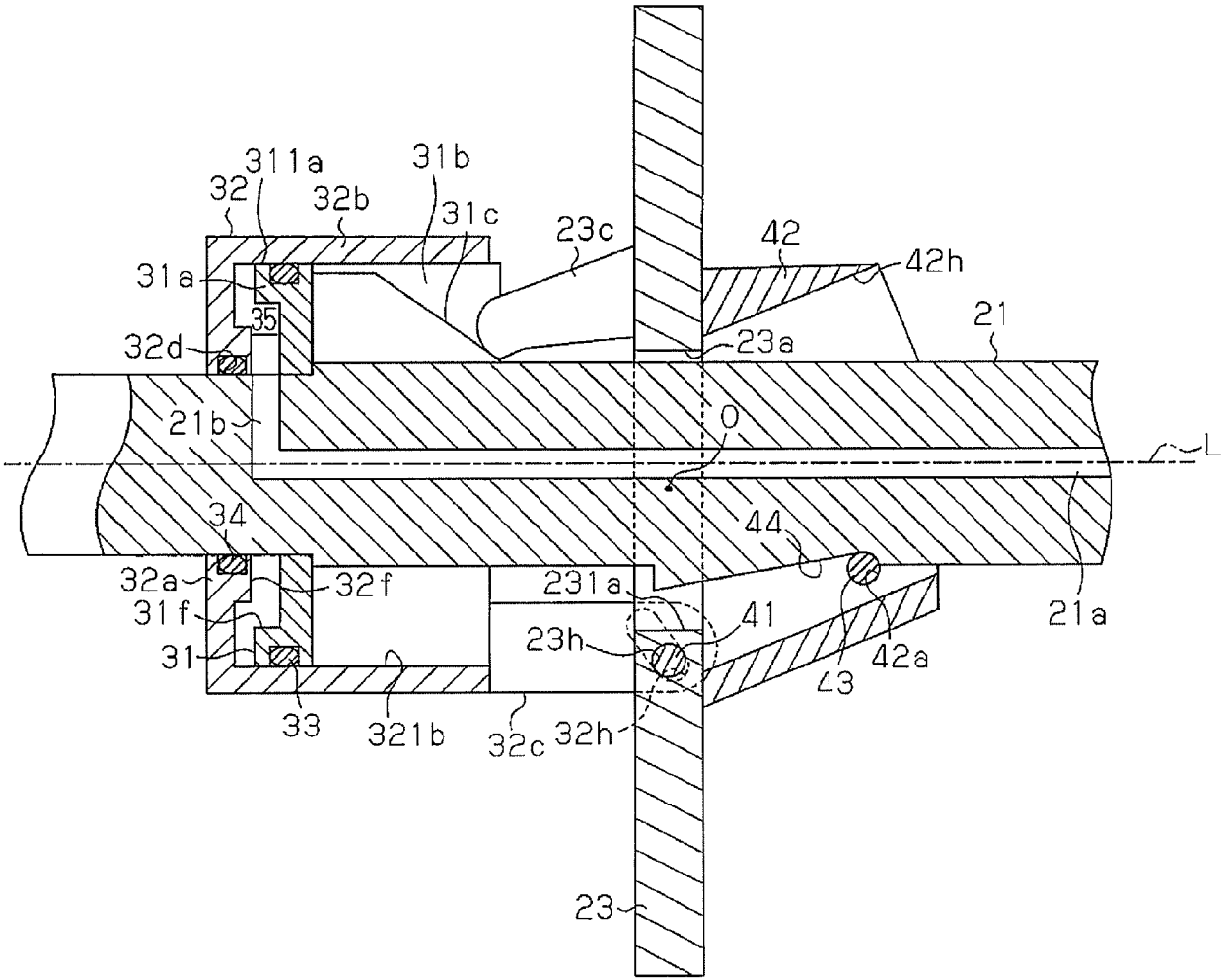
FIG. 5 is a partial, cross-sectional side view showing the compressor of FIG. 1 when the swash plate is located at the minimum inclination angle position.

Referring to FIG. 4, when the swash plate 23 is located at position corresponding to the maximum inclination θmax, the abutment pin 43 is guided by the guide surface 44 so that the center O of the swash plate 23 and the axis of the rotation shaft 21 coincide with each other. Referring to FIG. 5, when the swash plate 23 is located at a position corresponding to the minimum inclination θmin, the abutment pin 43 is guided by the guide surface 44 so that the center O of the swash plate 23 is located toward the abutment pin 43 from the axis L of the rotation shaft 21, that is, at the lower side of the axis L of the rotation shaft 21 in the present embodiment. In this manner, the sloped angle of the guide surface 44 is set so that the center O of the swash plate 23 and the axis of the rotation shaft 21 coincide with each other when the swash plate 23 is located at the position corresponding to the maximum inclination θmax, and the center O of the swash plate 23 is located toward the abutment pin 43 from the axis L of the rotation shaft 21 when the swash plate 23 is located at the position corresponding to the minimum inclination θmin.

The operation of the first embodiment will now be described.

Referring to FIG. 4, each double-headed piston 25 produces compression reaction forces P1 and P2 that act on the swash plate 23 in the compressor 10. The compression reaction forces P1 and P2 act on the swash plate 23 to change the inclination angle of the swash plate 23. When the inclination angle of the swash plate 23 is between the maximum inclination θmax and the minimum inclination θmin, the compression reaction force P1 is greater than the compression reaction force P2. The swash plate 23 tends to move in the radial direction of the rotation shaft 21 (upper direction as viewed in FIG. 4) when receiving the compression reaction forces P1 and P2. Here, force F1 from the swash plate 23 acts on the guide surface 44 of the rotation shaft 21 via the abutment pin 43. In this manner, the abutment pin 43 serves as a support that is supported by the rotation shaft 21.

On the outer surface of the rotation shaft 21, the guide surface 44 contacts the swash plate 23. However, surfaces of the rotation shaft 21 other than the guide surface 44 do not contact the swash plate 23. The wall surface of the insertion hole 23*a* includes a portion 231*a* located toward the guide surface 44. The insertion hole 23*a* is formed so that the portion 231*a* does not contact the rotation shaft 21. As shown in FIGS. 4 and 5, the portion 231*a* does not contact the rotation shaft 21 when the swash plate 23 has any inclination angle between the maximum inclination angle θmax and the minimum inclination angle θmin. The swash plate 23 is supported by the rotation shaft 21 through the drive force transmission member 31, the movable body 32, and the abutment pin 43. The inclination angle of the swash plate 23 relative to the rotation shaft 21 is set by the drive force transmission member 31, the movable body 32, and the abutment pin 43.

Due to the balance of forces, the reaction force F2 of the force F1, which acts on the guide surface 44 of the rotation shaft 21, acts on the swash plate 23 from the guide surface 44 through the abutment pin 43. The moment acting about the portion where the drive force transmission member 31 and the swash plate 23 are coupled, that is, the portion where the projection 23*c* and the guide surface 31*c* are in contact, will now be discussed. The reaction force F2 increases as the portion where the reaction force F2 acts on becomes closer to the portion where the drive force transmission member 31 and the swash plate 23 are coupled.

In the present embodiment, the abutment pin 43 is located at the rear side of the swash plate 23 in the axial direction of the rotation shaft 21. That is, the abutment pin 43 and the drive force transmission member 31 are located on opposite sides of the swash plate 23 in the axial direction of the rotation shaft 21. This separates the portion where the reaction force F2 acts on as far as possible from the coupling portion of the drive force transmission member 31 and the swash plate 23. Further, the reaction force F2 is minimized in the moment of the force acting on the swash plate 23 about the coupling portion of the drive force transmission member 31 and the swash plate 23. Thus, the inclination angle of the swash plate 23 is smoothly changed.

Further, in the axial direction of the rotation shaft 21, the abutment pin 43 is located on one side of the swash plate 23, and the drive force transmission member 31 and the movable body 32 are located on the opposite side of the swash plate 23. Thus, in comparison with when the abutment pin 43 is located at the front side of the swash plate 23 in the axial direction of the rotation shaft 21, components may be laid out in a scattered manner. This allows for reduction in the area occupied by the drive force transmission member 31 and the movable body 32 at the radially inner side of the region where the double-headed pistons 25 reciprocate.

Further, the abutment pin 43 is located in a portion separated from the drive force transmission member 31 and the movable body 32. This ensures an area in the axial direction of the rotation shaft 21 where the abutment pin 43 may be arranged. Thus, the abutment pin 43 is greatly separated from the coupling portion of the drive force transmission member 31 and the swash plate 23.

In the present embodiment, the upper end of the swash plate 23 is located farthest from the axis in the upper half of the swash plate 23. More specifically, the upper end of the swash plate 23 is the portion of the swash plate 23 where the outer diameter is largest and is located on the opposite side of the abutment pin 43 with respect to the rotation shaft 21. Distance H1 is the distance between the upper end of the swash plate 23 and the axis L of the rotation shaft 21. The lower end of the swash plate 23 is located farthest from the axis in the lower half of the swash plate 23. More specifically, the lower end of the swash plate 23 is the portion where the outer diameter is largest and located on the lower half of the swash plate 23 at the same side as the abutment pin 43 with respect to the rotation shaft 21. Distance H2 is the distance between the lower end of the swash plate 23 and the axis L of the rotation shaft 21. A change in the distance H1 and the distance H2 changes the inclination angle of the swash plate 23.

Figure 6:
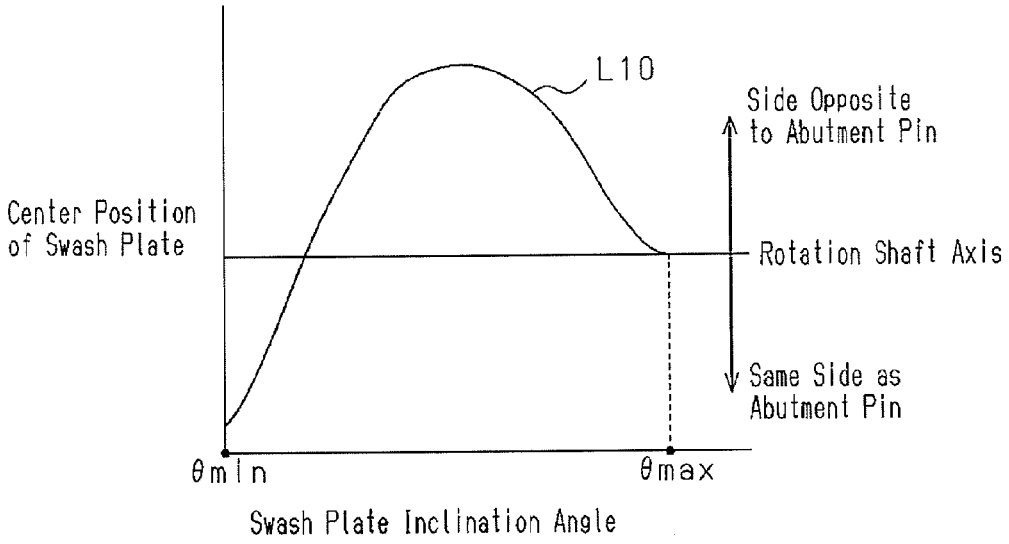
FIG. 6 is a graph showing movement of the center of the swash plate in FIG. 1.

In FIG. 6, solid line L10 shows movement of the center O of the swash plate 23 relative to the axis L of the rotation shaft 21 when the inclination angle of the swash plate 23 changes.

An example in which the abutment pin 43 guides the guide surface 44 under a situation in which the center O of the swash plate 23 is located above the axis L of the rotation shaft 21, that is, at the opposite side of the abutment pin 43 when the swash plate 23 is located at a position corresponding to the maximum inclination position θmax, and the center O of the swash plate 23 and the axis of the rotation shaft 21 coincide with each other when the swash plate 23 is located at a position corresponding to the minimum inclination position θmin will now be discussed. In this case, when the inclination angle of the swash plate 23 is changing, the center O of the swash plate 23 is greatly separated toward the upper side from the axis L of the rotation shaft 21.

This results in the maximum distance between the upper end of the swash plate 23 and the axis L being greater than the maximum distance between the lower end of the swash plate 23 and the axis L. Consequently, when the upper end of the swash plate 23 is most separated from the axis L, the swash plate 23 may interfere with the double-headed pistons 25. Thus, to avoid interference between the swash plate 23 and each double-headed piston 25, a cutout portion (recess) needs to be formed in the double-headed piston 25 near the swash plate 23.

In the present embodiment, the abutment pin 43 is guided by the guide surface 44 so that the center O of the swash plate 23 and the axis of the rotation shaft 21 coincide with each other when the swash plate 23 is located at the position corresponding to the maximum inclination angle θmax and the center O of the swash plate 23 is located at the lower side of the axis L, that is, toward the abutment pin 43, when the swash plate 23 is located at the position corresponding to the minimum inclination angle θmin. Thus, as shown by the sold line L10 in FIG. 6, when the inclination angle of the swash plate 23 changes, the center O of the swash plate 23 is not greatly separated to the upper side from the axis L of the rotation shaft 21.

Figure 7:
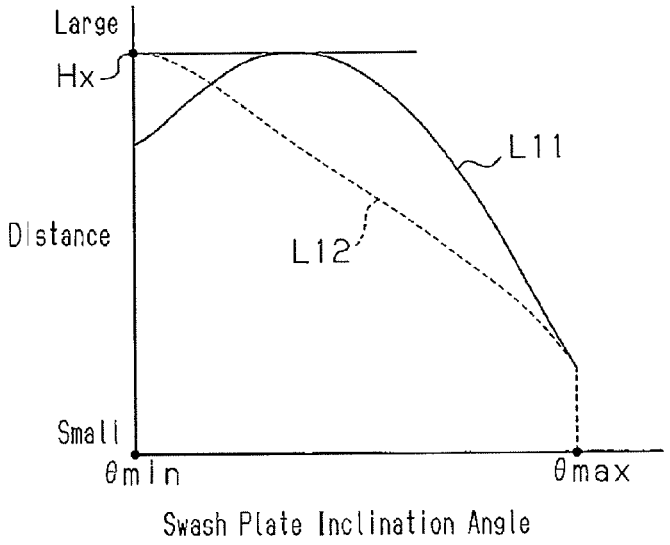
FIG. 7 is a graph showing movement of a first end and movement of a second end of the swash plate in FIG. 1.

In FIG. 7, solid line L11 indicates changes in the distance H1 when the inclination angle of the swash plate 23 changes, and broken line L12 shows changes in the distance H2 when the inclination angle of the swash plate 23 changes.

As shown in FIG. 7, the maximum value of the distance H1 (maximum distance between the upper end of the swash plate 23 and the axis L of the rotation shaft 21) and the maximum value of the distance H2 (maximum distance between the lower end of the swash plate 23 and the axis L of the rotation shaft 21) are both Hx and the same. This eliminates the need to form a cutout portion in each double-headed piston 25 near the swash plate 23.

The first embodiment has the advantages described below.

(1) The abutment pin 43 receives reaction force F2 that acts on the swash plate 23 from the rotation shaft 21. The abutment pin 43 is located at the rear side of the swash plate 23 in the axial direction of the rotation shaft 21. That is, the abutment pin 43 and the drive force transmission member 31 are arranged on opposite sides of the swash plate 23 in the axial direction of the rotation shaft 21. Thus, when reaction force F2 from the rotation shaft 21 acts on the swash plate 23, the portion where the reaction force F2 acts on is separated as far as possible from the coupling portion of the drive force transmission member 31 and the swash plate 23. When taking into consideration moment balancing of the force applied to the swash plate 23 about the coupling portion of the drive force transmission member 31 and the swash plate 23, the reaction force F2 acting on the swash plate 23 may be minimized. Thus, the inclination angle of the swash plate 23 may be smoothly changed. Further, the abutment pin 43 is arranged on the opposite side of the drive force transmission member 31 and the movable body 32 from the swash plate 23 in the axial direction of the rotation shaft 21. Hence, the area occupied by the drive force transmission member 31 and the movable body 32 at the radially inner side of the region where the double-headed pistons 25 reciprocate may be reduced in size compared to when the abutment pin 43 is located at the front side of the swash plate 23 in the axial direction of the rotation shaft 21. As a result, the inclination angle of the swash plate 23 may be smoothly changed while limiting enlargement in the size of the compressor 10.

(2) The rotation shaft 21 includes the guide surface 44 that guides the abutment pin 43 when the inclination angle of the swash plate 23 changes. The guide surface 44 is formed to guide the abutment pin 43 so that the center O of the swash plate 23 and the axis of the rotation shaft 21 coincide with each other when the swash plate 23 is located at a position corresponding to the maximum inclination angle θmax and the center O of the swash plate 23 is located closer to the abutment pin 43 than the axis L of the rotation shaft 21 when the swash plate 23 is located at a position corresponding to the minimum inclination angle θmin. Thus, the center O of the swash plate 23 does not greatly move away from the axis L of the rotation shaft 21 toward the side opposite to the abutment pint 43 from the rotation shaft 21 when the inclination angle of the swash plate 23 is being changed. This eliminates the need for the formation of a cutout portion in each double-headed piston 25 to avoid interference of the swash plate 23 with the double-headed piston 25. Further, the strength of the double-headed piston 25 may be ensured.

Second Embodiment

A second embodiment of the present invention will now be described with reference to FIGS. 8 to 10. In the description hereafter, like or same reference numerals are given to those components that are the same as the corresponding components of the first embodiment. Such components will not be described in detail.

Figure 8:
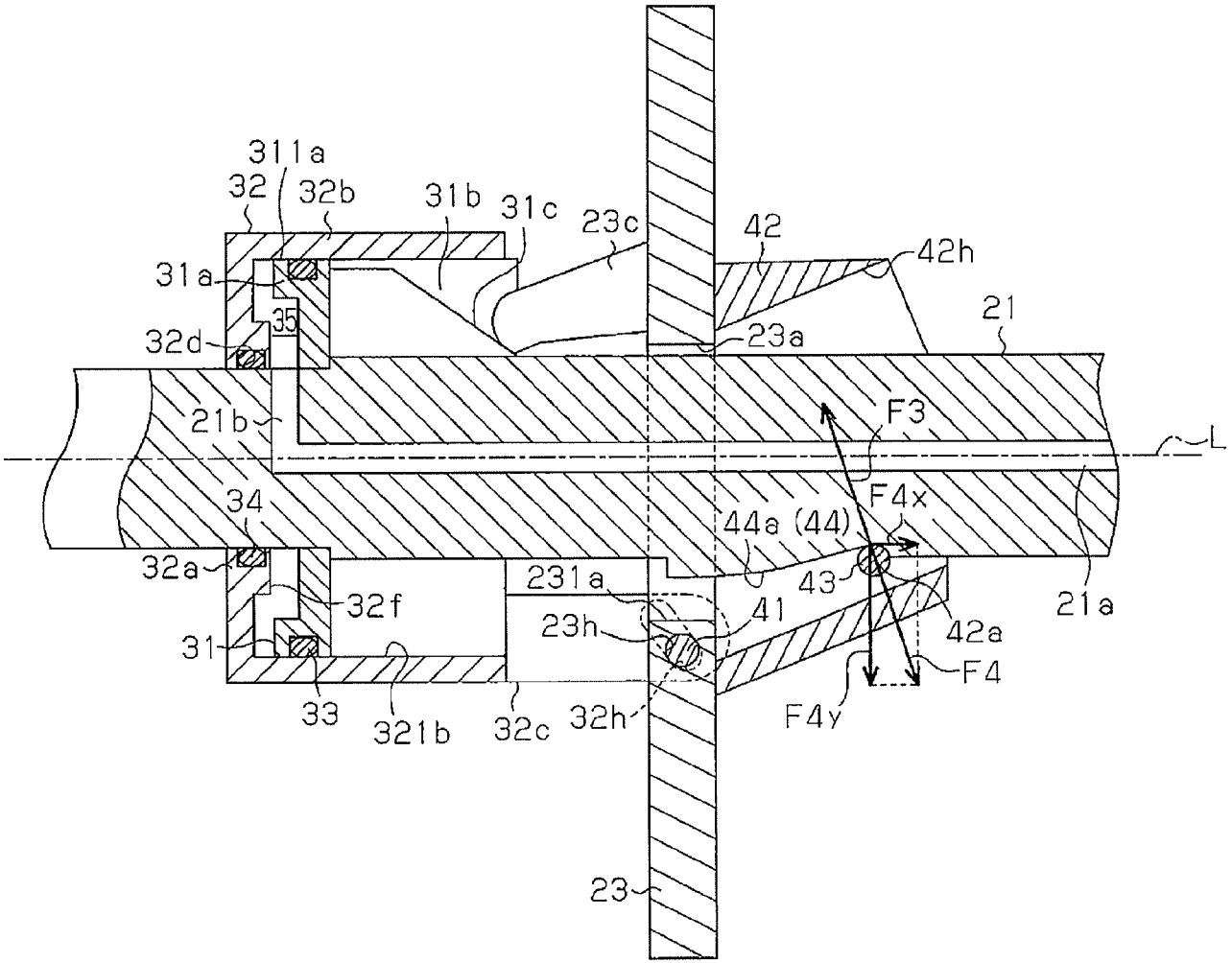
FIG. 8 is a partial, cross-sectional side view showing a double-headed piston type swash plate compressor according to a second embodiment of the present invention when the swash plate is located at the minimum inclination position.
Figure 9:
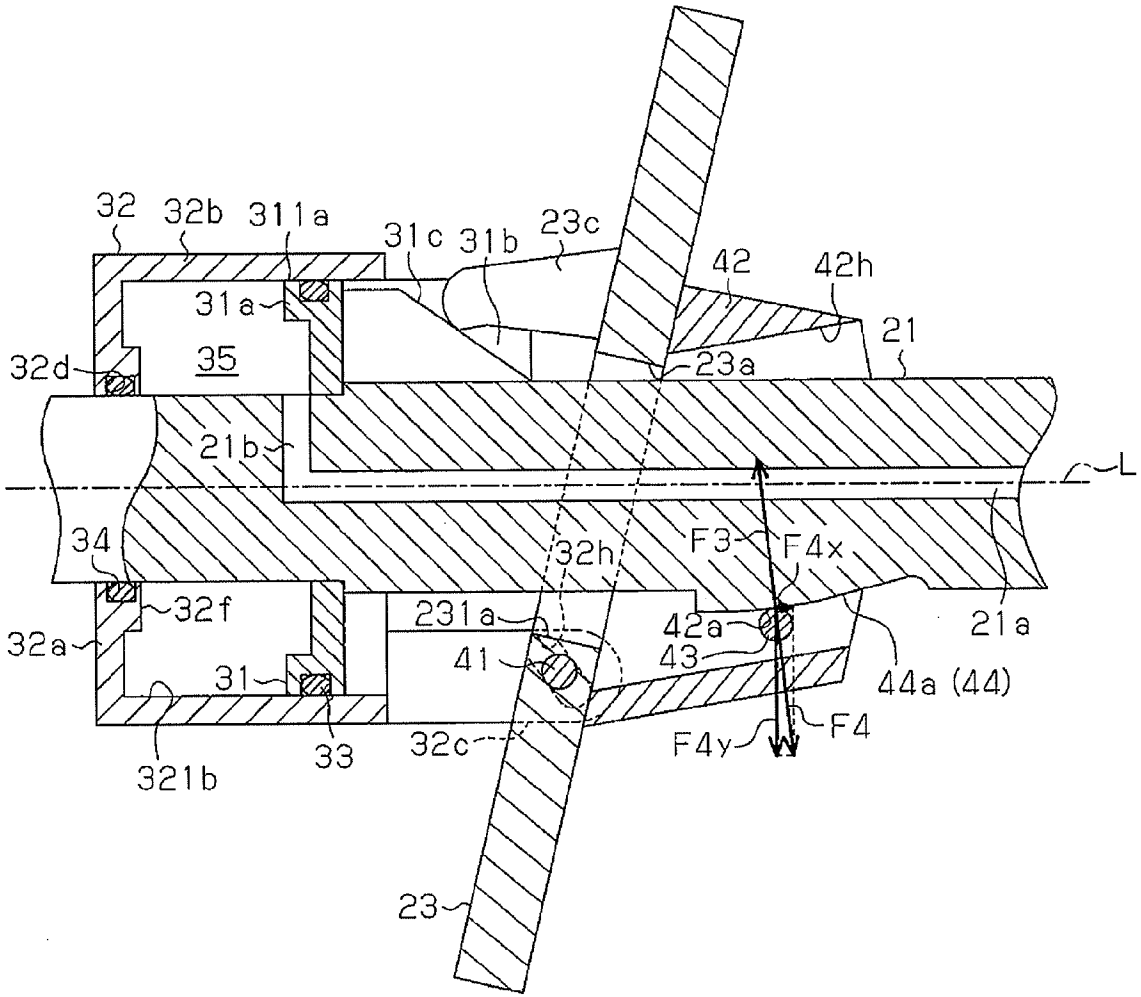
FIG. 9 is a partial, cross-sectional side view showing the compressor of FIG. 8 when the swash plate is located at the maximum inclination position.

Referring to FIGS. 8 and 9, the guide surface 44 includes a slope 44*a* that guides the abutment pin 43 so that the abutment pin 43 moves away from the axis L of the rotation shaft 21 as the movable body 32 moves in the direction in which the inclination angle of the swash plate 23 increases from the minimum inclination angle θmin. The slope 44*a* includes a portion, which curves in an arcuate manner so that the sloped angle of the slope 44*a* relative to the axis L of the rotation shaft 21 gradually decreases. In the second embodiment, the sloped angle of the slope 44*a* gradually decreases from the rear side to the front side along the axis L of the rotation shaft 21.

The operation of the second embodiment will now be described.

In the contact portion of the abutment pin 43 and the slope 44*a*, force F3 from the swash plate 23 acts on the slope 44*a* in the normal direction of the slope 44*a* through the abutment pin 43. In the contact portion of the slope 44*a* and the abutment pin 43, due to the balance of forces, force F4, which is the reaction force of force F3, from the slope 44*a* acts on the swash plate 23 through the abutment pin 43. The force F4 is divided into force F4y, which exerts in a direction (vertical direction) perpendicular to the movement direction of the movable body 32, and force F4x, which exerts along the movement direction (horizontal direction) of the movable body 32.

When controlling the inclination angle of the swash plate 23 under a situation in which the inclination angle of the swash plate 23 is close to the minimum inclination angle θmin, the pressure of the control pressure chamber 35 is close to the suction pressure. The pressure in the control pressure chamber 35 does not become lower than the suction pressure. Accordingly, if the necessary pressure of the control pressure chamber 35 that allows for the swash plate 23 to have the inclination angle close to the minimum inclination angle θmin is set to be lower than the suction pressure, the swash plate 23 cannot have the inclination angle close to the minimum inclination angle θmin.

Referring to FIG. 8, the force F4x is transmitted from the slope 44*a* to the movable body 32 through the abutment pin 43 and the swash plate 23. The force transmitted to the movable body 32 may obstruct movement of the movable body 32 when the movable body 32 moves in a direction that increases the inclination angle of the swash plate 23 from the minimum inclination angle θmin. Thus, the movable body 32 may not be moved unless the pressure of the control pressure chamber 35 is increased to a relatively high value.

Figure 10:
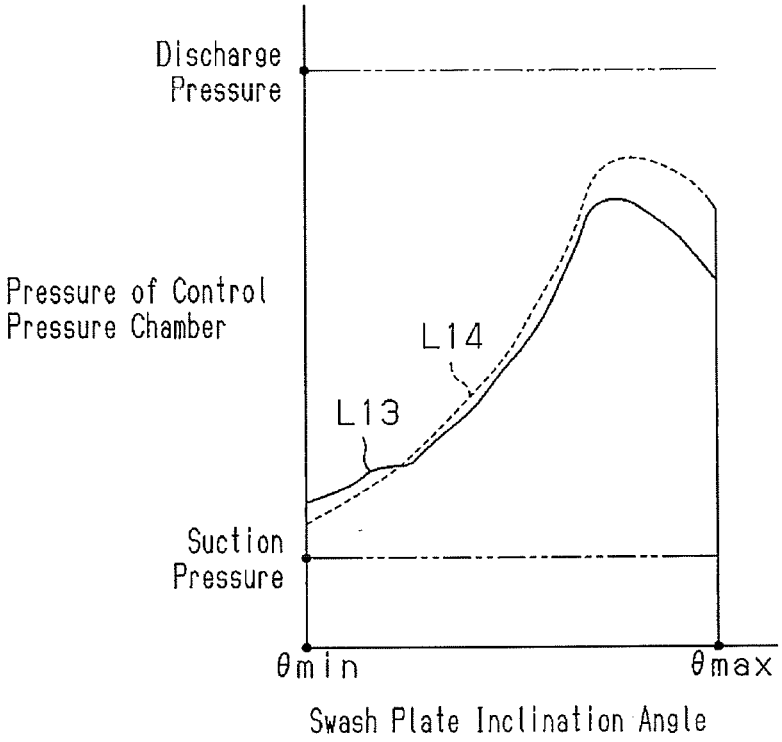
FIG. 10 is a graph showing the relationship of the pressure of the control pressure chamber and the inclination angle of the swash plate in FIG. 8.

In FIG. 10, solid line L13 shows the relationship of the pressure of the control pressure chamber 35 and the inclination angle of the swash plate 23 in the structure of the second embodiment illustrated in FIG. 8. Further, in FIG. 10, broken line L14 shows the relationship of the pressure of the control pressure chamber 35 and the inclination angle of the swash plate 23 in the structure of the first embodiment. In the first embodiment, as described above, the guide surface 44 is linearly sloped to approach the axis L of the rotation shaft 21 at locations farther from the swash plate 23.

When the inclination angle of the swash plate 23 is close to the minimum inclination angle θmin, the force F4x of the second embodiment is greater than the similar force in the first embodiment, that is, the force exerting in the movement direction of the movable body 32 that acts on the contact portion of the guide surface 44 and the abutment pin 43. As a result, as shown in FIG. 10, the necessary pressure of the control pressure chamber 35 that allows for the swash plate 23 to have the inclination angle close to the minimum inclination angle θmin is set to be higher than the suction pressure. Accordingly, the swash plate 23 can have the inclination angle close to the minimum inclination angle θmin. That is, the configuration according to the second embodiment improves the controllability of the swash plate 23.

When the swash plate 23 controls the inclination angle of the swash plate 23 under a situation in which the inclination angle of the swash plate 23 is close to the maximum inclination angle θmax, the pressure of the control pressure chamber 35 is close to the discharge pressure. The pressure in the control pressure chamber 35 does not become higher than the discharge pressure. Accordingly, if the necessary pressure of the control pressure chamber 35 that allows for the swash plate 23 to have the inclination angle close to the maximum inclination angle θmax is set to be higher than the discharge pressure, the swash plate 23 cannot have the inclination angle close to the maximum inclination angle θmax.

As shown in FIGS. 8 and 9, the sloped angle of the slope 44*a* gradually decreases. Thus, as shown in FIG. 9, the force F4x decreases as the movable body 32 moves in the direction in which the sloped angle of the swash plate 23 increases. As a result, when the movable body 32 moves in the direction in which the inclination angle of the swash plate 23 increases, the force that obstructs the movement of the movable body 32 becomes small. This allows for movement of the movable body 32 even when the pressure of the control pressure chamber 35 used to move the movable body 32 is relatively small.

When the inclination angle of the swash plate 23 is close to the maximum inclination angle θmax, the force F4x of the second embodiment is smaller than the similar force in the first embodiment, that is, the force exerting in the movement direction of the movable body 32 that acts on the contact portion of the guide surface 44 and the abutment pin 43. As a result, as shown in FIG. 10, the necessary pressure of the control pressure chamber 35 that allows for the swash plate 23 to have the inclination angle close to the maximum inclination angle θmax is set to be lower than the discharge pressure. Accordingly, the swash plate 23 can have the inclination angle close to the maximum inclination angle θmax. That is, the configuration according to the second embodiment improves the controllability of the swash plate 23.

Accordingly, in addition to advantages (1) and (2) of the first embodiment, the second embodiment has the advantages described below.

(3) The guide surface 44 includes the slope 44*a* that guides the abutment pin 43 away from the axis L of the rotation shaft 21 as the movable body 32 moves in the direction in which the inclination angle of the swash plate 23 increases from the minimum inclination angle θmin. As the movable body 32 moves in the direction in which the inclination angle of the swash plate 23 increases, the sloped angle of the slope 44*a* gradually decreases at the contact portion between the abutment pin 43 and the slope 44*a*. In the second embodiment, the sloped angle of the slope 44*a* at the contact portion between the abutment pin 43 and the slope 44*a* when the swash plate 23 has the minimum inclination angle θmin increases relative to that in the first embodiment. In this case, the force F4x in the second embodiment increases relative to that in the first embodiment. The force F4x is transmitted from the slope 44*a* to the movable body 32 through the abutment pin 43 and the swash plate 23. The force F4x transmitted to the movable body 32 may obstruct the movement of the movable body 32 when moving the movable body 32 in the direction that increases the inclination angle of the swash plate 23 from the minimum inclination angle θmin. Thus, in the second embodiment, the movable body 32 cannot be moved unless the pressure of the control pressure chamber 35 is increased relative to that in the first embodiment. As a result, as shown in FIG. 10, the necessary pressure of the control pressure chamber 35 that allows for the swash plate 23 to have the inclination angle close to the minimum inclination angle θmin is set to be higher than that in the first embodiment. That is, in the second embodiment, adjustment of the inclination angle of the inclined portion 44*a* enables to vary the necessary pressure of the control pressure chamber 35 that allows for the swash plate 23 to have the intended inclination angle.

Accordingly, the second embodiment overcomes the effects due to the design conditions for the structural members of the compressor that would be taken into consideration when determining the necessary pressure of the control pressure chamber 35 that allows for the swash plate 23 to have the intended inclination angle. Second embodiment improves the flexibility in the design of the compressor.

(4) As the movable body 32 moves in the direction in which the inclination angle of the swash plate 23 increases, the sloped angle of the slope 44*a* gradually decreases at the contact portion between the abutment pin 43 and the slope 44*a*. This decreases the force F4x acting on the contact portion between the slope 44*a* and the abutment pin 43 as the movable body 32 moves in the direction in which the inclination angle of the swash plate 23 increases. As a result, when the movable body 32 moves in the direction in which the inclination angle of the swash plate 23 increases, the force that obstructs movement of the movable body 32 may be decreased. This decreases the necessary pressure in the control pressure chamber 35 that allows for the movement of the movable body 32. In the second embodiment, the sloped angle of the slope 44*a* at the contact portion between the abutment pin 43 and the slope 44*a* when the swash plate 23 has the maximum inclination angle θmax decreases relative to that in the first embodiment. As a result, as shown in FIG. 10, the necessary pressure of the control pressure chamber 35 that allows for the swash plate 23 to have the inclination angle close to the maximum inclination angle θmax is set to be lower than that in the first embodiment. That is, in the second embodiment, adjustment of the inclination angle of the inclined portion 44*a* enables to vary the necessary pressure of the control pressure chamber 35 that allows for the swash plate 23 to have the intended inclination angle.

(5) In a conventional structure in which the double-headed piston 25 is accommodated in the first cylinder bore 12*a* and the second cylinder bore 13*a* to be movable back and forth, when changing the inclination angle of the swash plate 23, although the dead volume of the second compression chamber 20*b* is not drastically increased, the dead volume is increased by a certain extent. The dead volume of the second compression chamber 20*b* refers to the clearance between the double-headed piston 25 and the second valve-port formation body 17. However, in the second embodiment, the shape of the slope 44*a* allows for the position of the swash plate 23 to be moved in the axial direction. Thus, even when the inclination angle of the swash plate 23 is changed, depending on the shape of the slope 44*a*, the dead volume of the second compression chamber 20*b* may be kept fixed. That is, the dead volume may be adjusted by setting a suitable shape for the slope 44*a*.

Third Embodiment

A third embodiment of the present invention will now be described with reference to FIGS. 11 and 12. In the description hereafter, like or same reference numerals are given to those components that are the same as the corresponding components of the first embodiment. Such components will not be described in detail.

Figure 11:
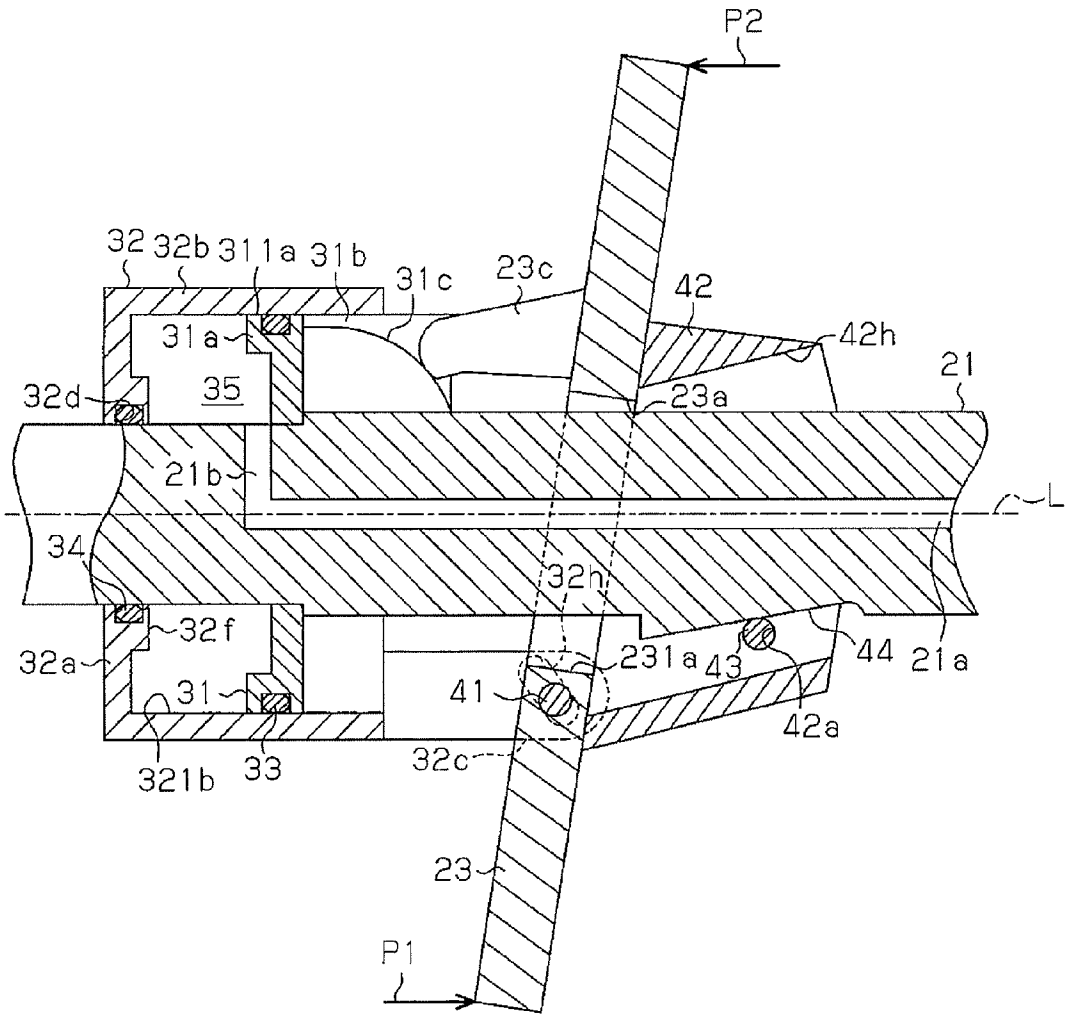
FIG. 11 is a partial, cross-sectional side view showing a double-headed piston type swash plate compressor according to a third embodiment of the present invention.

Referring to FIG. 11, the guide surface 31*c* is curved in an arcuate manner to bulge outward and toward the swash plate 23. More specifically, the sloped angle of the guide surface 31*c* relative to the axis L of the rotation shaft 21 differs between a front position and a rear position on the guide surface 31*c*. Thus, the inclination angle of the swash plate 23 changes in accordance with the sloped angle of the guide surface 31*c*.

The operation of the third embodiment will now be described.

In a structure in which the double-headed piston 25 is accommodated in the first cylinder bore 12*a* and the second cylinder bore 13*a* to be movable back and forth, compression reaction forces P1 and P2 from the double-headed piston 25 act on the swash plate 23 to decrease the inclination angle of the swash plate 23.

Further, in a structure in which the double-headed piston 25 is accommodated in the first cylinder bore 12*a* and the second cylinder bore 13*a* to be movable back and forth, as the inclination angle of the swash plate 23 decreases, the dead volume of the first compression chamber 20*a* increases. The dead volume of the first compression chamber 20*a* refers to the clearance between the double-headed piston 25 and the first valve-port formation body 16. In the second compression chamber 20*b*, the discharge stroke is performed without drastically increasing the dead volume. As the inclination angle of the swash plate 23 decreases from the maximum inclination angle θmax, the dead volume of the first compression chamber 20*a* increases. Thus, when the first compression chamber 20*a* is in the suction stroke, the re-expansion time is prolonged for decreasing the pressure of the first compression chamber 20*a* to the suction pressure. This increases the force from the double-headed piston 25 acting on the swash plate 23 to decrease the inclination angle of the swash plate 23.

As the inclination angle of the swash plate 23 decreases to a predetermined inclination angle θx, the dead volume of the first compression chamber 20*a* becomes a predetermined size. Here, the pressure of the first compression chamber 20*a* does not reach the discharge pressure. Thus, refrigerant gas is no longer discharged from the first compression chamber

20*a*. As the inclination angle of the swash plate 23 decreases from the predetermined inclination angle θx to the minimum inclination angle θmin, refrigerant gas is neither discharged nor drawn in, and the compression and expansion of refrigerant gas is repeated. This decreases the force that presses the double-headed piston 25 with the pressure of the first compression chamber 20*a* which, in turn, decreases the force from the double-headed piston 25 that acts on the swash plate 23 to decrease the inclination angle of the swash plate 23.

Figure 12:
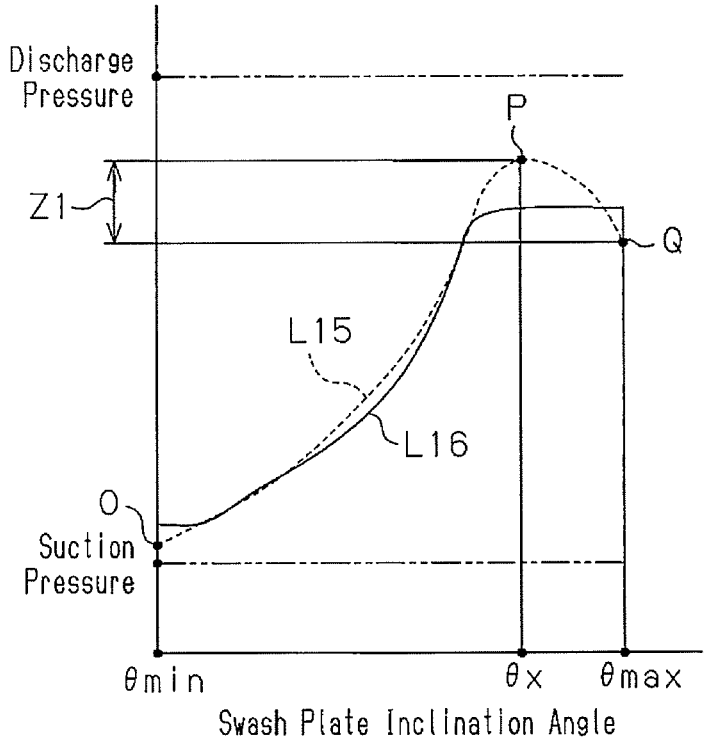
FIG. 12 is a graph showing the relationship of the pressure of the control pressure chamber and the inclination angle of the swash plate in FIG. 11.
Figure 13:
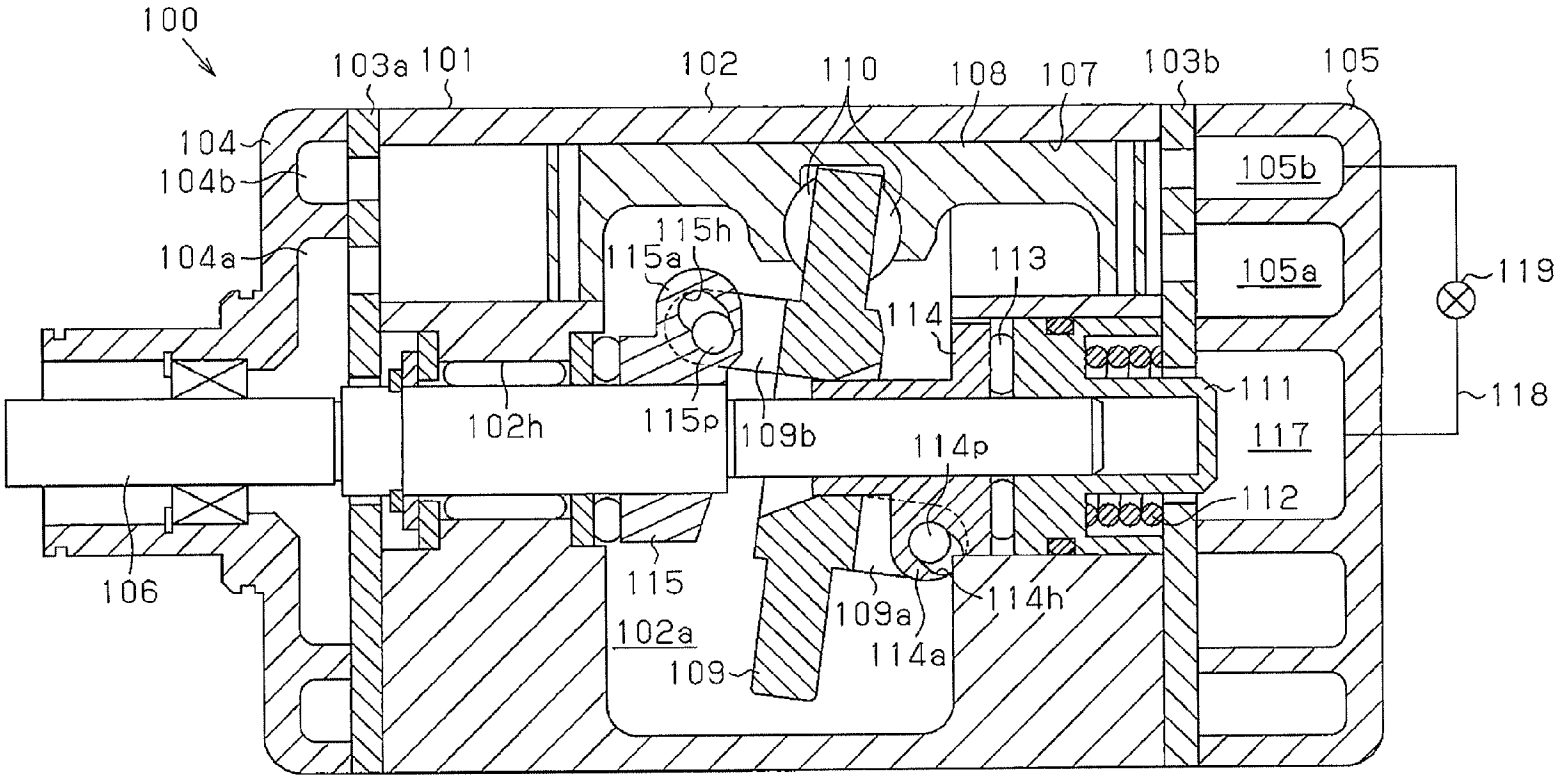
Fig.13(Prior Art)
FIG. 13 is a cross-sectional side view showing a prior art example variable displacement type swash plate compressor.
Figure 14:
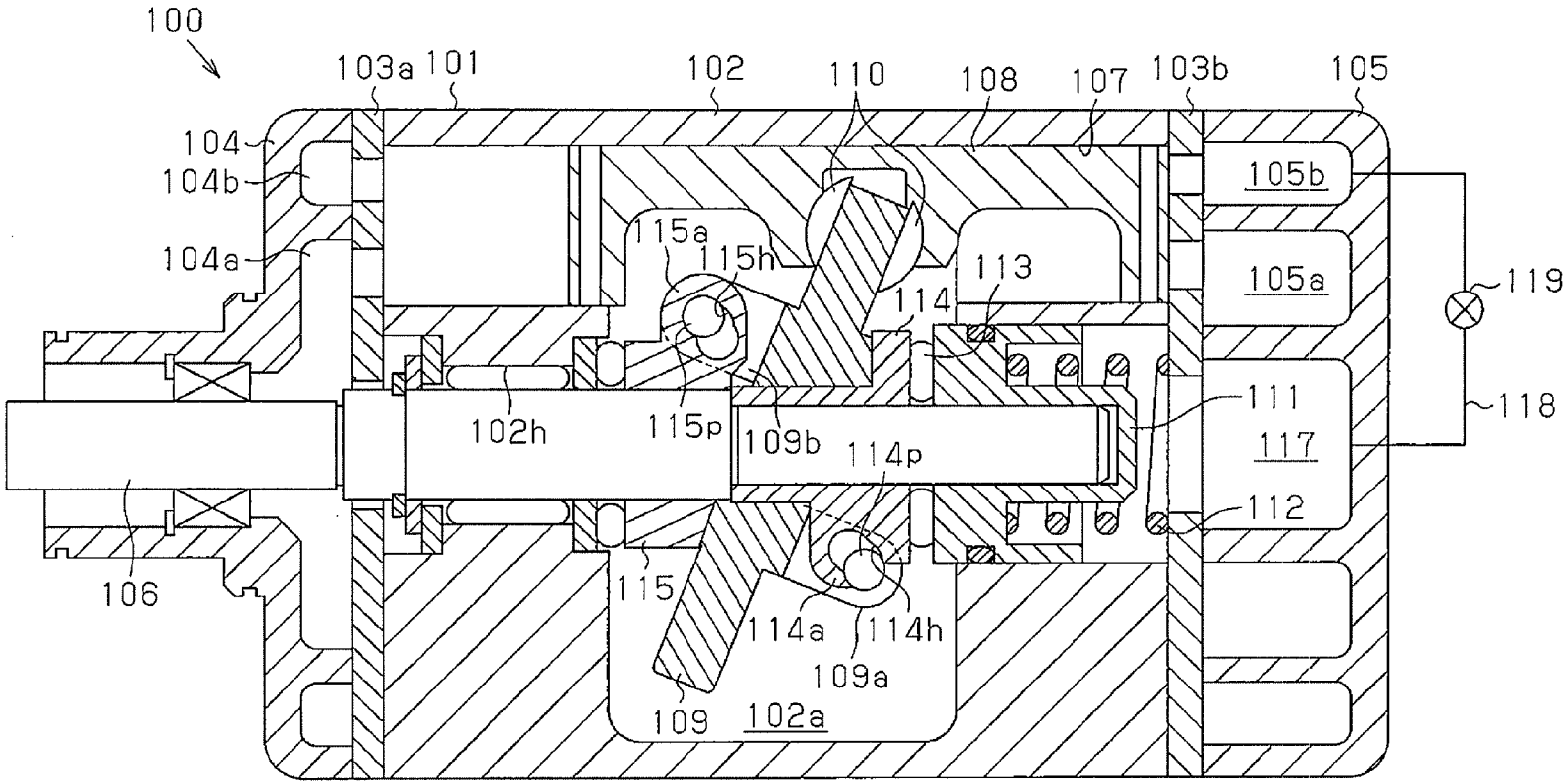
Fig.14(Prior Art)
FIG. 14 is a cross-sectional side view showing the variable displacement type swash plate compressor of FIG. 13 when a swash plate is located at a maximum inclination angle.

In FIG. 12, broken line L15 shows the relationship of the pressure of the control pressure chamber 35 and the inclination angle of the swash plate 23. In the first embodiment, the guide surface 31*c* is linearly sloped, and the sloped angle relative to the axis L of the rotation shaft 21 is fixed. As the inclination angle of the swash plate 23 changes from the minimum inclination angle θmin to a predetermined inclination angle θx, due to the re-expansion of the refrigerant gas in the first compression chamber 20*a*, the force from the double-headed piston 25 that acts on the swash plate 23 to decrease the inclination angle of the swash plate 23 is relatively small. Thus, as shown in FIG. 12, to increase the inclination angle of the swash plate 23 from the minimum inclination angle θmin to the predetermined inclination angle θx, the pressure of the control pressure chamber 35 only needs to be increased (condition from point O to point P in broken line L15).

As the inclination angle of the swash plate 23 changes from the predetermined inclination angle θx to the minimum inclination angle θmin, when the inclination angle of the swash plate 23 is the predetermined inclination angle θx, due to the re-expansion of the refrigerant gas in the first compression chamber 20*a*, the force from the double-headed piston 25 that acts on the swash plate 23 to decrease the inclination angle of the swash plate 23 is the greatest.

More specifically, when the inclination angle of the swash plate 23 is the predetermined inclination angle θx, the resultant force of the compression reaction forces P1 and P2 from the double-headed piston 25 acting on the swash plate 23 and the force generated by re-expansion of the refrigerant gas in the first compression chamber 20*a* is the greatest.

As the inclination angle of the swash plate 23 increases from the predetermined inclination angle θx to the maximum inclination angle θmax, the dead volume of the first compression chamber 20*a* decreases. This decreases the force generated by the re-expansion of the refrigerant gas in the first compression chamber 20*a*.

The pressure of the control pressure chamber 35 that maintains the inclination angle of the swash plate 23 is the greatest when the inclination angle of the swash plate 23 is the predetermined inclination angle θx. As the inclination angle of the swash plate 23 increases from the predetermined inclination angle θx to the maximum inclination angle θmax, the pressure of the control pressure chamber 35 decreases (condition of point P to point Q in broken line L1). As a result, in the prior art, the pressure of the control pressure chamber 35 required to increase the inclination angle of the swash plate 23 from the predetermined inclination angle θx to the maximum inclination angle θmax and the pressure of the control pressure chamber 35 required to increase the inclination angle of the swash plate 23 from the minimum inclination angle θmin to the predetermined inclination angle θx take the same value and exist in range Z1. Thus, it is difficult to accurately control the inclination angle of the swash plate 23.

As shown in FIG. 11, in the present embodiment, the sloped angle of the swash plate 23 is adjusted to receive force from the double-headed piston 25 acting on the swash plate 23 to decrease the inclination angle of the swash plate 23 at the contact portion of the guide surface 31*c* and the projection 23*c*. This decreases the force from the double-headed piston 25 that acts on the swash plate 23 to decrease the inclination angle of the swash plate 23. Thus, as shown by solid line L16 in FIG. 12, the pressure of the control pressure chamber 35 only needs to be raised to increase the inclination angle of the swash plate 23 from the minimum inclination angle θmin to the maximum inclination angle θmax.

Accordingly, in addition to advantages (1) and (2), the third embodiment has the advantages described below.

(6) The sloped angle of the guide surface 31*c* relative to the axis L of the rotation shaft 21 differs between a front position and a rear position on the guide surface 31*c*. Thus, the inclination angle of the swash plate 23 changes in accordance with the sloped angle of the guide surface 31*c*. The sloped angle of the guide surface 31*c* relative to the axis of the rotation shaft 21 is varied to receive force from the double-headed piston 25 acting on the swash plate 23 to decrease the inclination angle of the swash plate 23. This decreases the force from the double-headed piston 25 that acts on the swash plate 23 to decrease the inclination angle of the swash plate 23. Thus, the pressure of the control pressure chamber 35 only needs to be raised to increase the inclination angle of the swash plate 23 from the minimum inclination angle θmin to the maximum inclination angle θmax.

(7) In the third embodiment, the shape of the guide surface 31*c* allows the axial position of the swash plate 23 to be changed. Thus, even when the inclination angle of the swash plate 23 is changed, depending on the shape of the guide surface 31*c*, the dead volume of the second compression chamber 20*b* may be kept fixed. In other words, the dead volume may be adjusted by setting a suitable shape for the guide surface 31*c*.

It should be apparent to those skilled in the art that the present invention may be embodied in many other specific forms without departing from the spirit or scope of the invention. Particularly, it should be understood that the present invention may be embodied in the following forms.

The guide surface 44 in the first and third embodiments may be changed to the slope 44*a* of the second embodiment. The guide surface 31*c* of the first and second embodiments may be changed to the guide surface 31*c* of the third embodiment.

In each of the above embodiments, the abutment pin 43 may be guided by the guide surface 44 so that the center O of the swash plate 23 and the axis of the rotation shaft 21 coincide with each other when the swash plate 23 is located at the position corresponding to the maximum inclination angle θmax and the swash plate 23 is located at the position corresponding to the minimum inclination angle θmin.

In each of the above embodiments, the left side, right side, upper side, and lower side in the drawings may be changed when necessary.

In each of the above embodiments, the upper end of the swash plate 23 is located at a position that is the farthest from the axis in the upper half of the swash plate 23. However, the position that is the farthest from the axis in the upper half of the swash plate 23 does not have to be the upper end of the swash plate 23. Further, the lower end of the swash plate 23 is located at a position that is the farthest from the axis in the lower half of the swash plate 23. However, the position that is the farthest from the axis in the lower half of the swash plate 23 does not have to be the lower end of the swash plate 23.

The present examples and embodiments are to be considered as illustrative and not restrictive, and the invention is not to be limited to the details given herein, but may be modified within the scope and equivalence of the appended claims.

The invention claimed is:

1. A double-headed piston type swash plate compressor comprising:

a first cylinder block and a second cylinder block that form a housing, wherein the first cylinder block includes a first cylinder bore, and the second cylinder block includes a second cylinder bore;

a rotation shaft;

a double-headed piston accommodated in the first cylinder bore and the second cylinder bore, wherein the double-headed piston is movable back and forth in the first cylinder bore and the second cylinder bore;

a crank chamber;

a drive force transmission member accommodated in the crank chamber and fixed to the rotation shaft, wherein the drive force transmission member is rotatable integrally with the rotation shaft;

a swash plate accommodated in the crank chamber, wherein the swash plate is rotated when receiving drive force from the rotation shaft through the drive force transmission member, the swash plate is inclined at an angle relative to the rotation shaft that is changeable, the swash plate is coupled to the double-headed piston, and the double headed piston moves back and forth with a stroke that is in accordance with the inclination angle of the swash plate;

a movable body coupled to the swash plate, wherein the movable body is capable of changing the inclination angle of the swash plate;

a control pressure chamber defined by the movable body in the housing, wherein the control pressure chamber draws in control gas that changes the pressure in the control pressure chamber to move the movable body in an axial direction of the rotation shaft; and a support located on the swash plate and supported by the rotation shaft, wherein the drive force transmission member and the movable body are located at a first side of the swash plate in the axial direction of the rotation shaft, the support is located at a second side of the swash plate that is opposite from the first side in the axial direction of the rotation shaft, the swash plate is supported by the rotation shaft through the drive force transmission member, the movable body, and the support, the inclination angle of the swash plate relative to the rotation shaft is set by the drive force transmission member, the movable body, and the support, the drive force transmission member includes a main body, and two arms which project from an end face of the main body toward the swash plate, a bottom portion defining a first guide surface extends between the two arms, the swash plate includes a projection that projects from the swash plate toward the drive force transmission member, the projection is located between the two arms and slides along the first guide surface, and when the swash plate is inclined at a minimum inclination angle, at least a part of the first guide surface is arranged inside the movable body.

2. The double-headed piston type swash plate compressor according to claim 1, wherein the rotation shaft includes a second guide surface that guides the support as the inclination angle of the swash plate changes, the second guide surface guides the support so that the center of the swash plate and an axis of the rotation shaft coincide with each other when the swash plate is inclined at a maximum inclination angle, and the second guide surface guides the support so that the center of the swash plate is located toward the support from the axis of the rotation shaft when the swash plate is inclined at the minimum inclination angle.

3. The double-headed piston type swash plate compressor according to claim 2, wherein the second guide surface includes a slope that guides the support away from the axis of the rotation shaft as the movable body moves in a direction in which the inclination angle of the swash plate increases from the minimum inclination angle, the slope is configured so that a sloped angle of the slope gradually decreases in a portion where the support and the slope come into contact as the movable body moves in a direction that increases the inclination angle of the swash plate; and the sloped angle of the slope is the angle of the slope relative to the axis of the rotation shaft.

4. The double-headed piston type swash plate compressor according to claim 1, wherein the first guide surface is configured to have a sloped angle that varies in a portion where the projection and the first guide surface come into contact as the inclination angle of the swash plate changes, and the sloped angle of the first guide surface is the angle of the first guide surface relative to an axis of the rotation shaft.

* * * * *